US005696333A

United States Patent [19]

Shih

[11] Patent Number: 5,696,333

[45] Date of Patent: Dec. 9, 1997

[54] MUSIC JEWELRY CABINET

[76] Inventor: Barry Shih, 2F, No. 321, Pateh Rd., Sec. 4, Taipei 10563, Taiwan

[21] Appl. No.: 696,596

[22] Filed: Aug. 14, 1996

[51] Int. Cl.[6] ..... G10F 1/06

[52] U.S. Cl. ..... 84/95.2; 446/303; 446/482; 206/6.1

[58] Field of Search ..... 84/95.2, 94.2, 84/95.1, 94.1; 446/298, 303, 265, 404, 482; 206/6.1; 312/114; 40/411, 414, 415

[56] References Cited

U.S. PATENT DOCUMENTS 2,807,118 9/1957 Reuge ..... 85/95.2
5,422,429 6/1995 Shih et al. ..... 84/94.2

*Primary Examiner*—Cassandra C. Spyrou

*Attorney, Agent, or Firm*—W. Wayne Liauh

[57] ABSTRACT

A music jewelry cabinet having a space left behind a top drawer thereof for mounting a music-producing means therein. A spring winding shaft projects from the music-producing means to extend out of a back of the cabinet so that it is easily accessible for winding a spring of the music-producing means. A cylinder having bosses on its circumferential surface has a shaft upward extended into a showcase with clear door above the drawer to connect an ornament thereto. When the spring winding shaft is turned and then released, the spring of the music-producing means releases the stored kinetic energy to rotate the cylinder to produce pleasant music and to rotate the ornament. A braking shaft backward projects from a back wall of the top drawer and will insert into a flywheel when the drawer is closed, so that the flywheel is stuck and the cylinder is prevented from rotating at the same time.

2 Claims, 6 Drawing Sheets

MUSIC JEWELRY CABINET

BACKGROUND OF THE INVENTION

1. Field of the Invention

The present invention relates to a music jewelry cabinet, and more particularly to a big-sized music jewelry cabinet in which an ornament may rotate along with a music-producing means controlled by a wound spring, so as to give the jewelry cabinet more than one interesting function.

2. Description of the Prior Art

Most of the conventional music jewelry boxes can produce music only when the box is opened. No other function is provided by the jewelry box. FIG. 1 illustrates another kind of conventional music jewelry box in which a rotatable ornament is provided. Such music jewelry box includes a top cover A to which a board B is connected. To a bottom surface of the board B, a tune-producing device C having a spring winding shaft D is mounted. An ornament E is fixed to the spring winding shaft D at a proper position and a ring F is attached to a top end of the shaft D for turning the shaft D and thereby winding a spring in the tune-producing device C. When the ring F is released, the tune-producing device C produces musical tunes and the ornament E rotates along with the shaft D. A leaf spring G is fixed to one side of the tune-producing device C. When the top cover A of the jewelry box is closed, the leaf spring G shall extend into a flywheel H to stop the tune-producing device C. Such music jewelry box produces music and the attached ornament rotates only when the top cover A is opened. Since the top cover A is normally closed to block dust, the jewelry box substantially looks like any other music boxes without any valuable feeling. The rotatable ornament E and the leaf spring G must be designed to suit to a cover-controlled music jewelry box. In case the rotatable ornament is to be placed in the above described music jewelry box at a certain compartment for display at any time, it will be difficult to wind the spring. On the other hand, a rotatable ornament E fixed to the spring winding shaft D may have only limited formations.

The wooden horse illustrated in FIG. 1 is only a somewhat suitable design. Other designs would very possibly project from the spring winding shaft D and the ring F, and adversely affect the whole beauty of the jewelry box.

It is therefore tried by the inventor to develop a music jewelry cabinet having improved structure to eliminate the drawbacks existed in the conventional music jewelry boxes.

SUMMARY OF THE INVENTION

A primary object of the present invention is to provide a music jewelry cabinet which includes a music-producing means having an extended shaft for an ornament to attach thereto and to rotates at the same time the music is produced.

Another object of the present invention is to provide the above music jewelry cabinet in which the music-producing means is mounted behind a back board of an upper drawer disposed inside the cabinet with a spring winding shaft of the music-producing means backward extends through a rear side of the cabinet and a central shaft of the music-producing means upward extends for connecting a rotatable ornament thereto. The rotatable ornament is therefore always disposed inside the cabinet without constantly contacting with dust. Clear showcases provided on the jewelry cabinet permit the elegant rotating ornament to be viewed at any time.

A further object of the present invention is to provide the above music jewelry cabinet in which a braking shaft is fixed by screw to the back board of the upper drawer, such that when the upper drawer is closed, the braking shaft shall insert into a flywheel of the music-producing means to stop the music automatically.

DETAILED DESCRIPTION OF THE PREFERRED EMBODIMENT

Figure 1:
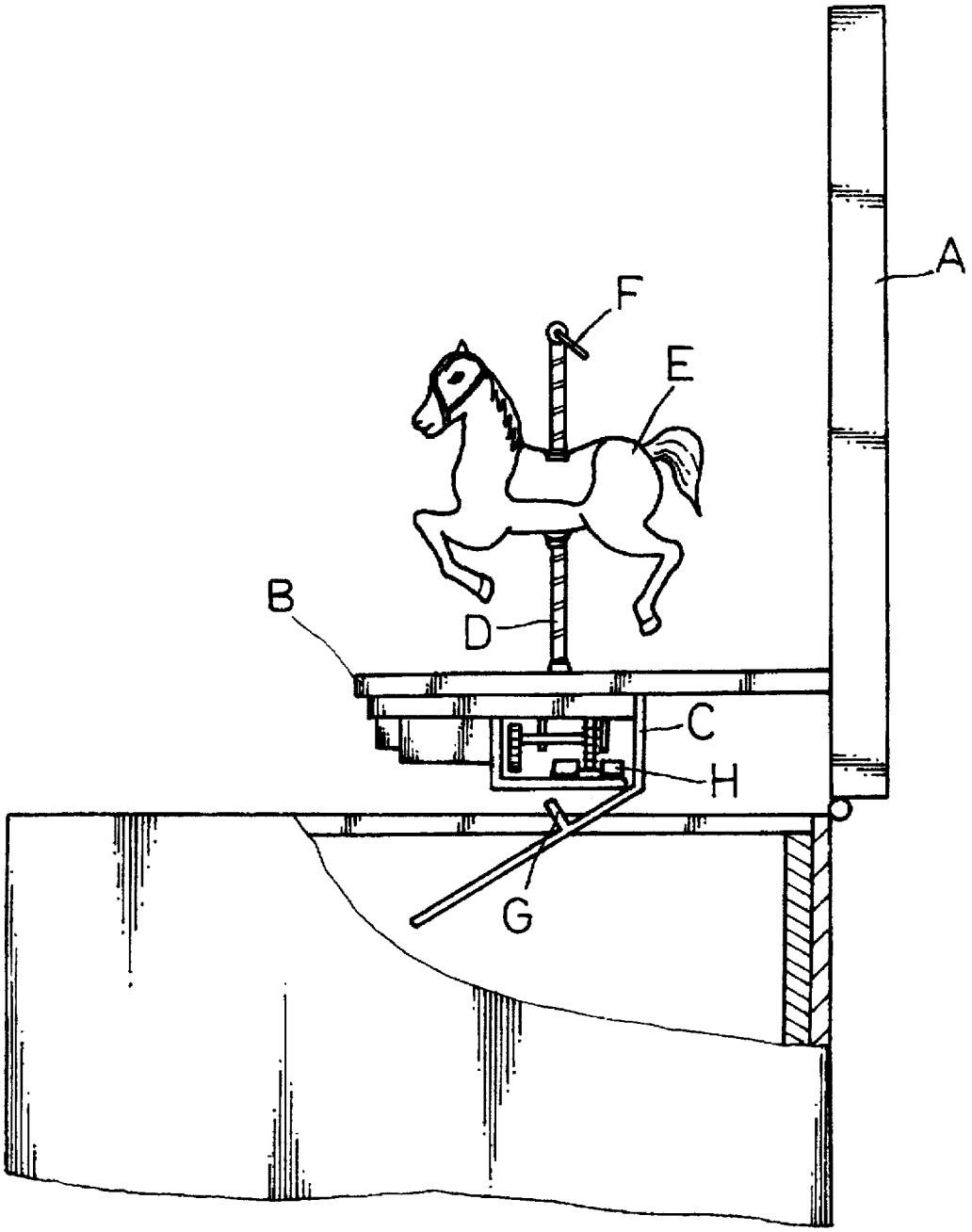
(PRIOR ART) FIG. 1
FIG. 1 is an elevational side view of a conventional music jewelry box.
Figure 2:
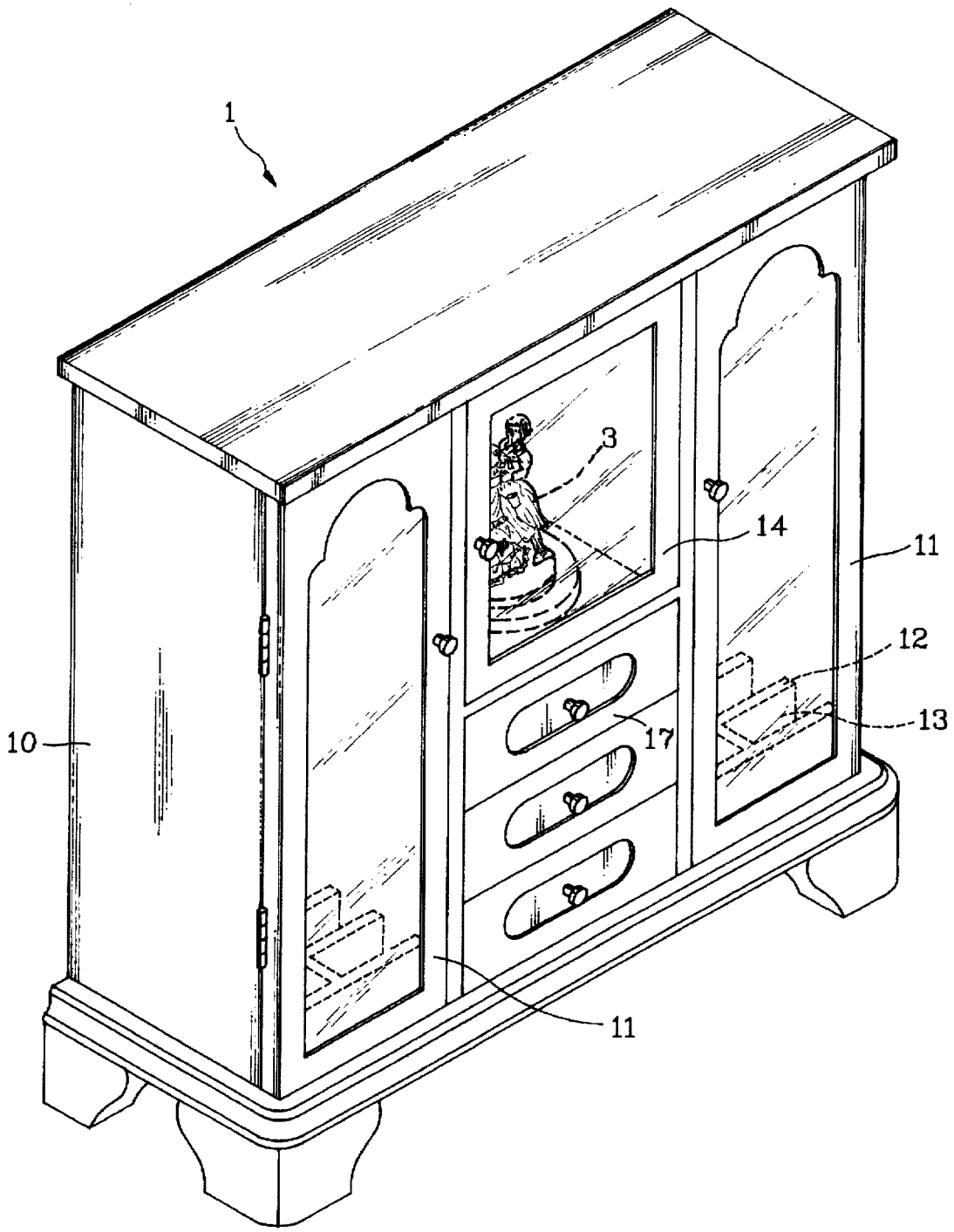
FIG. 2 is a perspective view showing an embodiment of the music jewelry cabinet according to the present invention.
Figure 3:
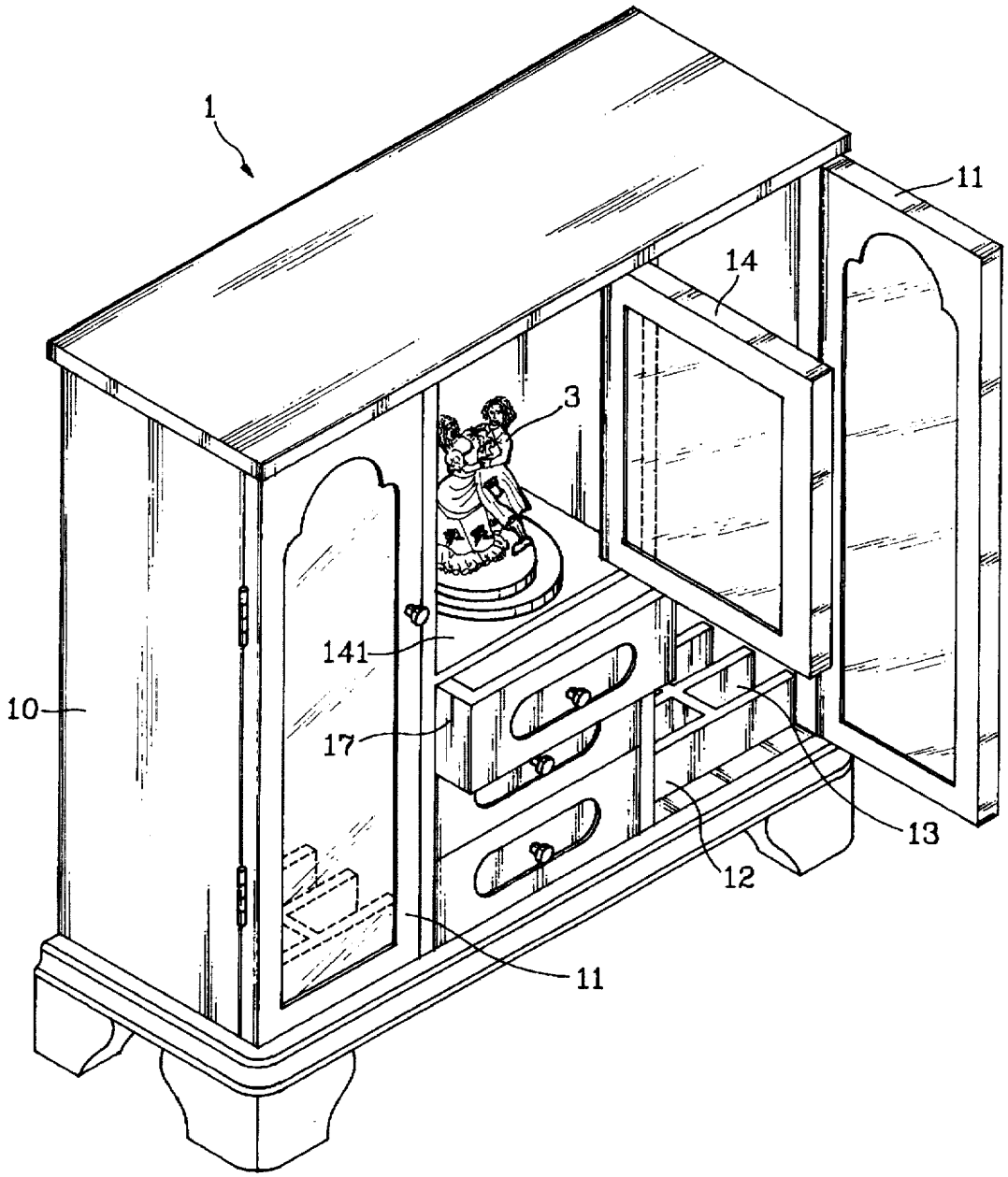
FIG. 3 is similar to FIG. 2 but with two clear doors of the showcases and an upper drawer thereof in an open state.
Figure 4:
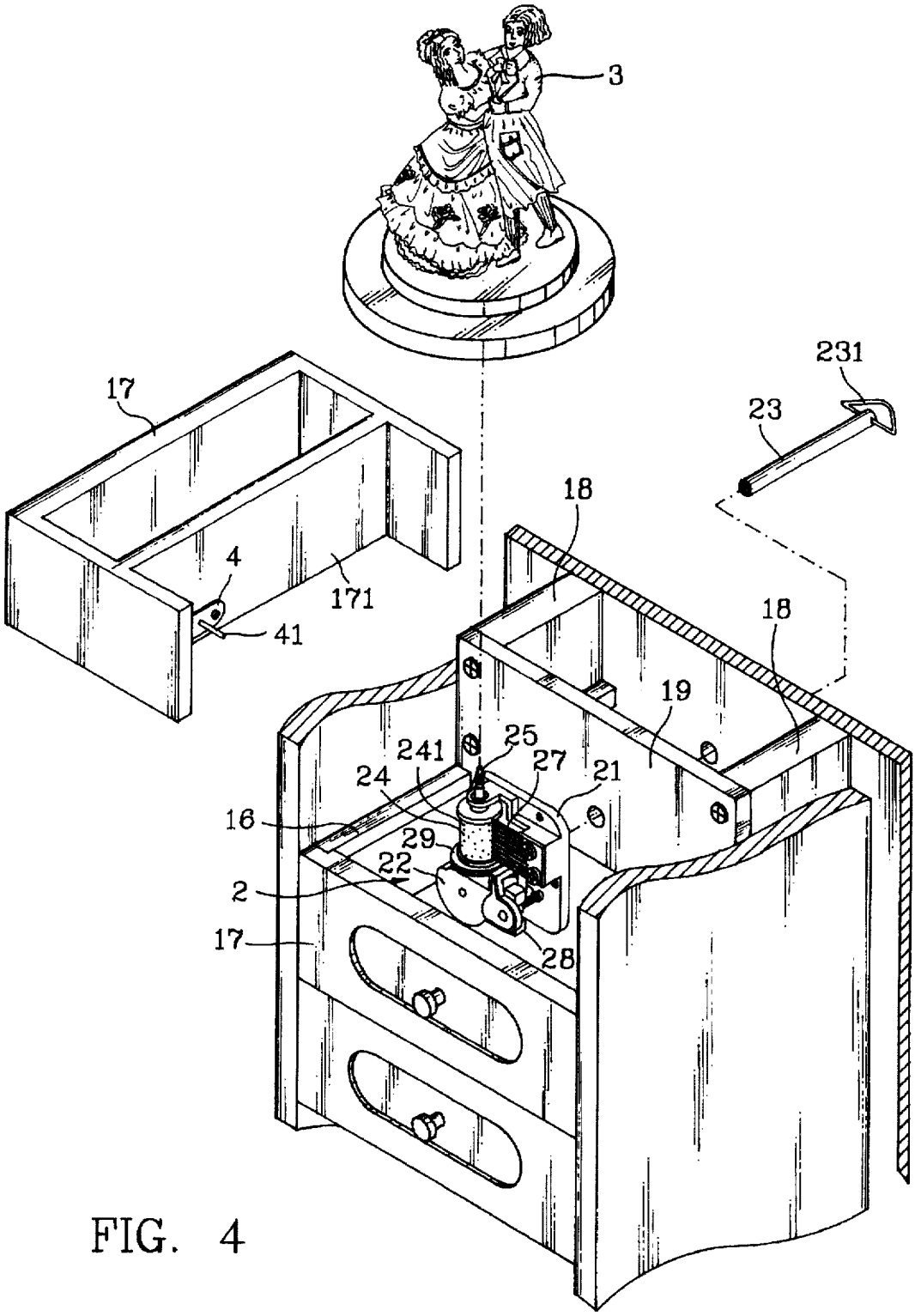
FIG. 4 is a fragmentary exploded perspective of the present invention showing the structure of a part of the cabinet at where the music-producing means is located.

Please refer to FIGS. 2, 3 and 4, in which an embodiment of the present invention is shown. The present invention is a music jewelry cabinet 1 looking like a deluxe wardrobe. The music jewelry cabinet 1 mainly includes a cabinet 10 of which two sides are two symmetrical showcases with clear glass doors 11. Mirrors (not shown) may be provided to inner walls of the showcases and hangers (not shown) may be provided to a top wall of the showcases for hanging necklaces, bracelets, etc. A bottom surface of each of the showcases may be divided into four square compartments 13 by means of partitions 12 so as to receive jewelry, such as earrings, finger rings, etc. that are small in volume. An upper middle showcase with a clear glass middle door 14 is provided at an upper center of the cabinet 10, left a middle recess below it. A bottom board 141 of the middle showcase is formed with a central round hole 15. Multiple pairs of rails 16 are provided to two side walls of the middle recess below the middle showcase, so that more than one drawer 17 can be superposed on one another in the middle recess.

As can be clearly seen from FIG. 4, two backward extended side supports 18 and a transversely extended back board 19 are further attached to a rear portion of the top drawer rails 16. The side supports 18 may be adhered to the rails 16 and the back board 19 may be fixed to the side supports by screws to be substantially parallel to a back of the cabinet 10.

A music-producing means 2 is mounted on a front surface of the back board 19. The music-producing means 2 includes a supporting frame 21 firmly secured to the back board 19 by means of screws, a spring 22 mounted to a lower portion of the supporting frame 21, a rotatable spring winding shaft 23 normal to the spring 22 and having one inner end extended into a center of the spring 22 and one outer end projected out of the back board 19 and the back of the cabinet 10 to connect a ring 321 or any other turning knob, a cylinder 24 having a plurality of specially arranged bosses 241 formed on a circumferential surface thereof and being connected to an upper portion of the supporting frame 21, an extended shaft 25 projecting from a top end of the cylinder 24 to extend through the central round hole 15 of the middle showcase and having threads 26 formed on a top outer surface thereof, a leaf spring 27 consisting of multiple lines of springy members and being attached to an upper portion of the supporting frame 21 opposite to the cylinder 24 so that a front edge thereof properly contacting with the bossed surface of the cylinder 24, and a flywheel 28 having multiple blades and being connected to a lower portion of the supporting frame 21 opposite to the spring 22. Whereby, when the spring winding shaft 23 is turned to tighten the spring 22 and is then release, the spring 22 shall release kinetic energy to bring the spring winding shaft 23 to rotate in the other direction. The turning of the spring winding shaft 23 shall cause a gear set 29 between the spring 22 and the cylinder 24 to rotate the cylinder 24 at the same time. Following a contact of the leaf spring 27 with the bosses 241 on the rotating cylinder 24, pleasant music is produced. Meanwhile, the gear set 29 also bring the flywheel 28 to rotate along with the cylinder 24.

Figure 5:
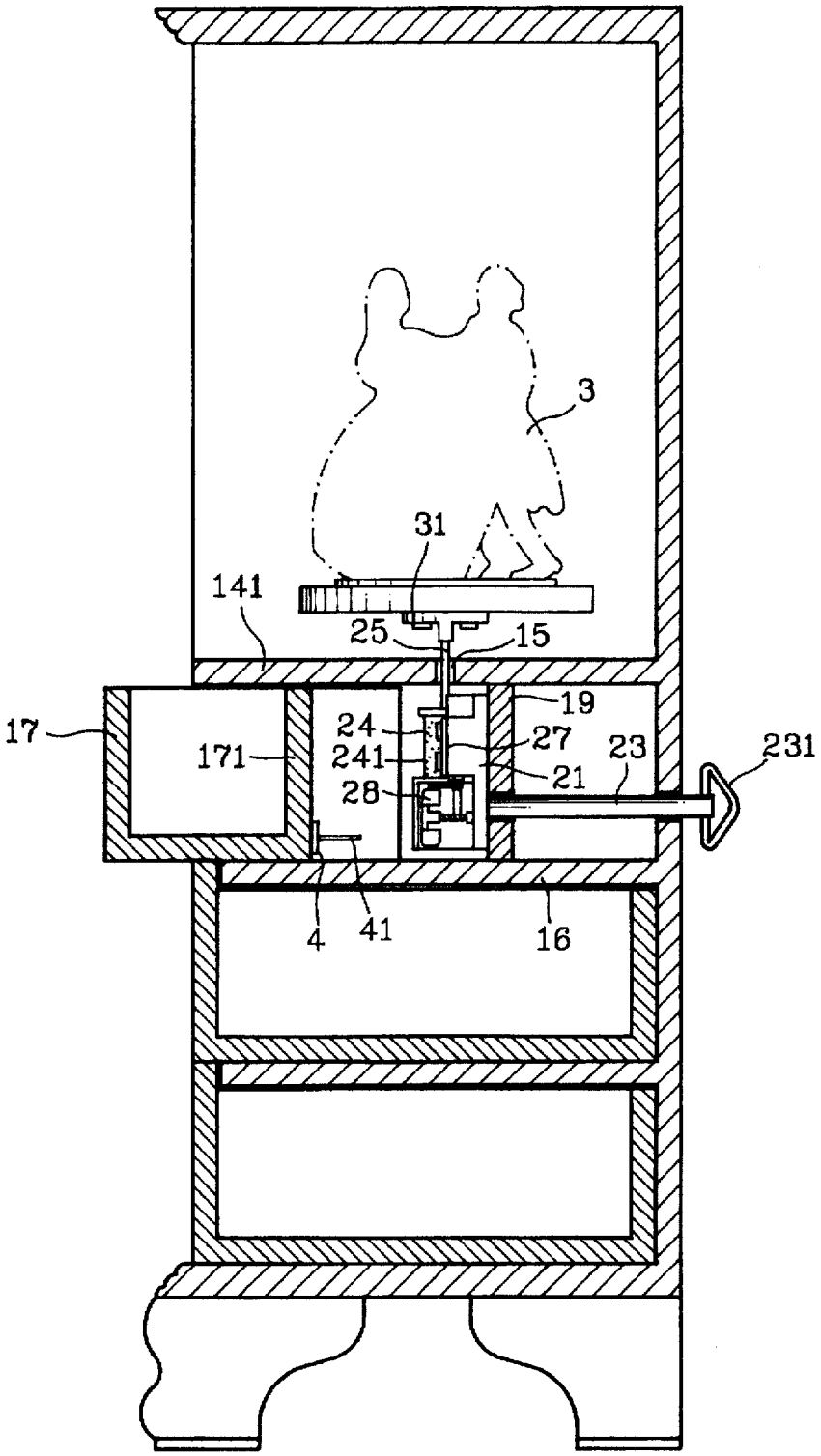
FIG. 5 is a sectional side view of the present invention with the upper drawer at an extended position.

Please refer to FIG. 5 now. A rotatable ornament 3 having an internally threaded seat 31 screwed to a bottom thereof is disposed inside the upper middle showcase. The extended sham 25 of the music cylinder 24 upward extends through the round hole 15 of the bottom board 141 and into the seat 31 with its external threads 26 engaged with the internal threads of the seat 31, so that the ornament 3 is supported on the extended shaft 25 and is rotatable along with the rotating cylinder 24.

Figure 6:
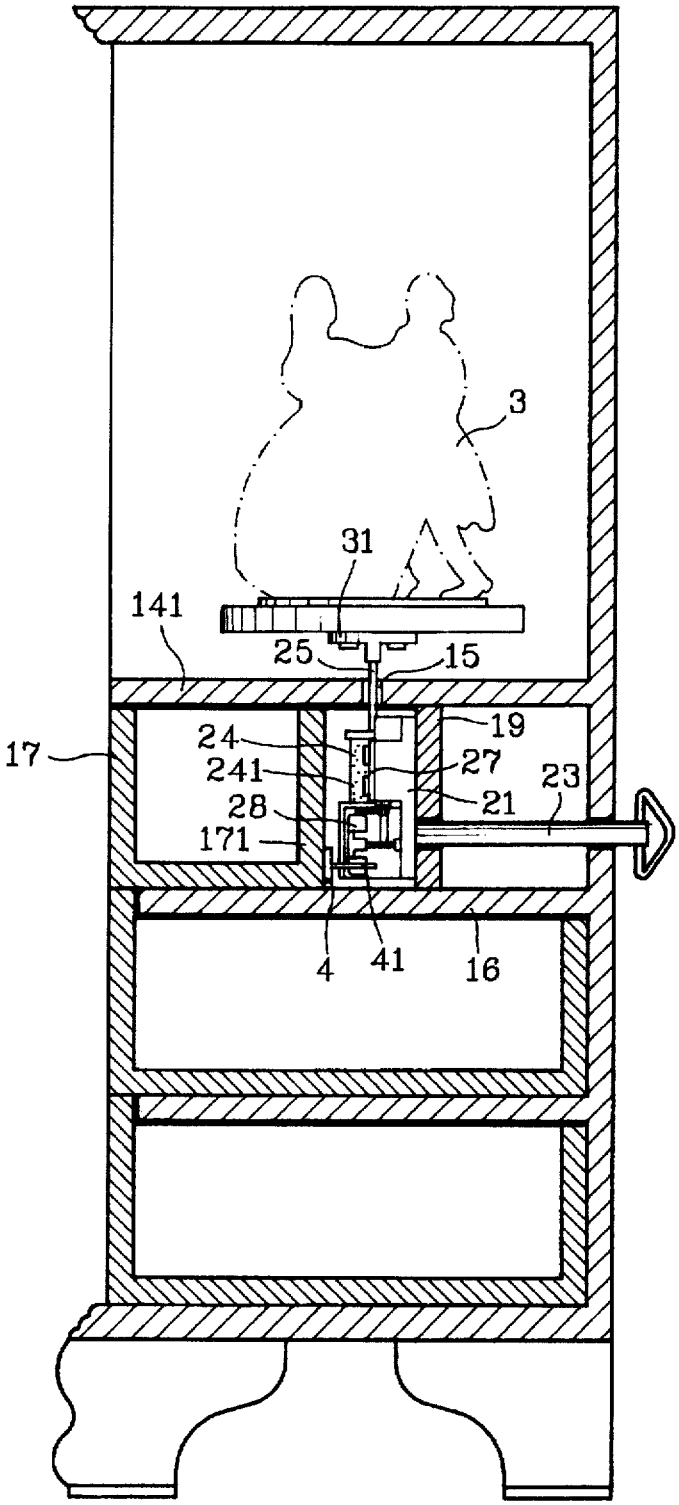
FIG. 6 is a similar to FIG. 5 but with the upper drawer at a closed position.

As shown in FIG. 4, a braking shaft seat 4 is screwed to a back wall 171 of the top drawer 17 near a lower edge thereof. For the back board 19 and the music-producing means 3 to locate behind the top drawer 17, the back wall 171 of the top drawer 17 is slightly shortened, whereby when the top drawer 17 is pushed inward to close it, as shown in FIG. 6, a braking shaft 41 backward projected from the braking shaft seat 4 shall insert into a clearance between two of the blades of the flywheel 28, stopping the flywheel 28 from further rotating. The music-producing means 2 and the ornament 3 also stop at the same time.

The spring winding shaft 23 is turned by holding and turning the ring 231 or other suitable knob attached thereto. When the spring winding shaft 23 is turned, the spring 22 is tightened to store kinetic energy. When the top drawer 17 is pulled out, the braking shaft 41 disengages from the flywheel 28, and the gear set 29 is allowed to be driven by the tightened and then released spring 22, causing the cylinder 24 to rotate and produce pleasant music while the ornament 3 attached to the extended shaft 25 above the cylinder 24 rotates along with the cylinder 24, giving the jewelry cabinet 1 an interesting scene.

Since the spring winding shaft 23 projects out of the back of the cabinet 10, it is easily accessible for turning and thereby tighten the spring 22. In addition, since the ornament 3 is attached to the extended shaft 25 of the rotational cylinder 24 instead of being attached to the spring winding shaft as it would do in the conventional music jewelry boxes, the design of the ornament 3 may be changeful with less limitation. And, since the production of pleasant music and the rotation of the ornament 3 is controlled by opening or closing the top drawer 17, the ornament 3 can be always positioned inside the upper middle showcase to avoid dust and can be viewed at any time.

What is claimed is:

1. A music jewelry cabinet, comprising:

a cabinet having an upper middle showcase with a pivotally connected clear glass door, more than one superposed drawer provided below said upper middle showcase, and a back board transversely extended behind a top drawer;

a music-producing means including a supporting frame firmly secured to said back board, a spring mounted to a lower portion of said supporting frame, a rotatable spring winding shaft normal to the spring and having one inner end extended into a center of the spring and one outer end projected out of said back board and a back of said cabinet to connect a turning element, a cylinder having a plurality of specially arranged bosses formed on a circumferential surface thereof and being connected to an upper portion of said supporting frame, an extended shaft projected from a top end of said cylinder and having threads formed on a top outer surface thereof, a leaf spring consisting of multiple lines of springy members and being attached to an upper portion of said supporting frame opposite to said cylinder so that a front edge thereof properly contacting with said bossed surface of said cylinder, and a flywheel having multiple blades and being connected to a lower portion of said supporting frame opposite to said spring, whereby when said spring is tightly wound by turning said spring winding shaft and then released, a gear set mounted between said spring and said cylinder being driven to rotate the flywheel and the cylinder with said bosses contacting with said leaf spring, producing pleasant music;

an rotational ornament having an internally threaded seat screwed to a bottom thereof and being disposed inside said upper middle showcase, said internally threaded seat being engaged with said externally threaded extended shaft upward projected from said cylinder; and a braking shaft seat being screwed to a back wall of said top drawer near a lower edge thereof and having a braking-shaft backward projected therefrom, said braking shaft inserting into said flywheel when said top drawer is pulled inward to close it and thereby stopping said flywheel and accordingly said cylinder from further rotating.

2. A music jewelry cabinet as claimed in claim 1, wherein said turning element pivotally connected to said spring winding shaft is a ring.

* * * * *